US007946811B2

(12) United States Patent
Abgrall et al.

(10) Patent No.: US 7,946,811 B2
(45) Date of Patent: May 24, 2011

(54) ASSEMBLY OF SECTORIZED FIXED STATORS FOR A TURBOMACHINE COMPRESSOR

(75) Inventors: Olivier Abgrall, Melun (FR); Yvon Cloarec, Ecuelles (FR)

(73) Assignee: SNECMA, Paris (FR)

( * ) Notice: Subject to any disclaimer, the term of this patent is extended or adjusted under 35 U.S.C. 154(b) by 1157 days.

(21) Appl. No.: 11/625,967

(22) Filed: Jan. 23, 2007

(65) Prior Publication Data

US 2007/0172349 A1 Jul. 26, 2007

(30) Foreign Application Priority Data

Jan. 24, 2006 (FR) ..... 06 00616

(51) Int. Cl.
*F01D 9/04* (2006.01)

(52) U.S. Cl. ..... 415/209.4; 415/191

(58) Field of Classification Search ..... 415/189, 415/191, 193, 199.5, 209.3, 209.4
See application file for complete search history.

(56) References Cited

U.S. PATENT DOCUMENTS

| | | | | |
|---|---|---|---|---|
| 3,365,173 | A * | 1/1968 | Lynch et al. | 415/209.3 |
| 4,856,963 | A * | 8/1989 | Klapproth et al. | 415/190 |
| 6,514,041 | B1 * | 2/2003 | Matheny et al. | 415/177 |
| 2005/0111969 | A1 | 5/2005 | Arness et al. | |
| 2005/0232764 | A1 * | 10/2005 | Chiu et al. | 415/214.1 |

FOREIGN PATENT DOCUMENTS

| | | |
|---|---|---|
| EP | 1 505 259 A1 | 2/2005 |
| FR | 1 252 179 | 12/1960 |
| FR | 2 664 944 | 1/1992 |
| FR | 2 674 909 | 10/1992 |

* cited by examiner

*Primary Examiner* — Nathaniel Wiehe
(74) *Attorney, Agent, or Firm* — Oblon, Spivak, McClelland, Maier & Neustadt, L.L.P.

(57) ABSTRACT

An assembly of sectorized fixed compressors for a turbomachine compressor is disclosed. The assembly is a single piece and includes two coaxial rings connected by radial airfoils. The outer ring includes two annular mounting lugs on a casing of the compressor. At least one of these annular lugs is connected to the outer ring in a zone axially separate from the zone for connecting the leading edges or trailing edges of the airfoils to the outer ring.

15 Claims, 2 Drawing Sheets

ASSEMBLY OF SECTORIZED FIXED STATORS FOR A TURBOMACHINE COMPRESSOR

The present invention relates to an assembly of sectorized fixed stators for a turbomachine compressor, such as an aircraft turbojet or turbofan.

BACKGROUND OF THE INVENTION

A turbomachine compressor comprises several compression stages each comprising an annular array of mobile blades mounted on a shaft of the turbomachine, and an annular array of fixed stators supported by an outer casing.

Each annular array of fixed stators is sectorized and formed of assemblies of stators mounted circumferentially end-to-end about the axis of the compressor, each assembly of stators comprising two coaxial rings connected together by radial airfoils, and being formed either in a single cast piece, or by the ends of the airfoils being attached to the rings.

An assembly formed by casting has a lesser axial space requirement than an assembly formed by attaching the airfoils to the rings, but the leading and trailing edges of the airfoils of this one-piece assembly are connected to portions of the outer ring that are themselves connected to annular mounting lugs on the outer casing and that are therefore thick and very rigid.

Consequently, the stresses to which the leading and trailing edges of the airfoils are subjected in operation are supported essentially by these leading and trailing edges that are thin and not very strong and are not partly cushioned by the outer ring, which may cause deterioration or destruction of the leading and trailing edges of the airfoils in their zones of connection to the outer ring.

SUMMARY OF THE INVENTION

The main object of the invention is to prevent this disadvantage while retaining the advantages of assemblies of fixed stators formed in a single cast piece.

Consequently, it proposes an assembly of sectorized fixed stators for a turbomachine compressor, made in a single piece and comprising two rings, inner and outer, extending coaxially one inside the other, radial airfoils extending between the rings and connected by their radial ends to the rings, and two outer annular lugs supported by the outer ring and extending at the outside of the latter, for mounting the assembly of stators on a casing, wherein at least one of the annular mounting lugs is connected to the outer ring in a zone axially separate from the zone for connecting the leading and trailing edges of the airfoils to the outer ring.

According to the invention, the connection of the leading and/or trailing edges of the airfoils to portions of the outer ring that are less rigid than those connected to the annular mounting lugs makes it possible to transfer the forces better between the leading and trailing edges of the airfoils and the ring and hence to cause at least one portion of the stresses to which the leading and trailing edges of the airfoils are subjected in operation to be supported by the ring. The result of this is a significant increase in the service life of these fixed stator assemblies.

According to another feature of the invention, at least one of the axial ends of the outer ring comprises a rim that extends substantially parallel to one of the annular mounting lugs and to which the leading edges or the trailing edges of the airfoils are connected.

The shapes and dimensions of the or each rim of the outer ring are determined so that this rim has sufficient flexibility to better distribute the stresses of the leading or trailing edges of the airfoils in operation.

In one embodiment of the invention, the upstream end of the outer ring comprises a rim that is connected to the leading edges of the airfoils and that extends substantially parallel to the upstream annular lug.

As a variant or as an additional feature, the downstream end of the ring comprises a rim that is connected to the trailing edges of the airfoils and that extends substantially parallel to the downstream annular lug.

The or each annular mounting lug that extends substantially parallel to such a rim of the outer ring is connected to a mid-portion of this ring, which may have a radial dimension or thickness that is different and for example greater than that of the rim.

The mid-portion of the outer ring may have a radial dimension or thickness optimized for the specific frequencies of the airfoils and of the rings while also improving the transmission of stresses between the airfoils and the outer ring.

The invention also relates to a turbomachine compressor that comprises at least one annular array of fixed stators made of assemblies of stators as described hereinabove, mounted circumferentially end-to-end about the axis of the compressor, and a turbomachine, such as an aircraft turbojet or turbofan, comprising such a compressor.

BRIEF DESCRIPTION OF THE DRAWINGS

The invention will be better understood and other details, features and advantages of the present invention will appear more clearly on reading the following description, given as a nonlimiting example with reference to the appended drawings, in which.

DESCRIPTION OF THE PREFERRED EMBODIMENTS

Figure 1:
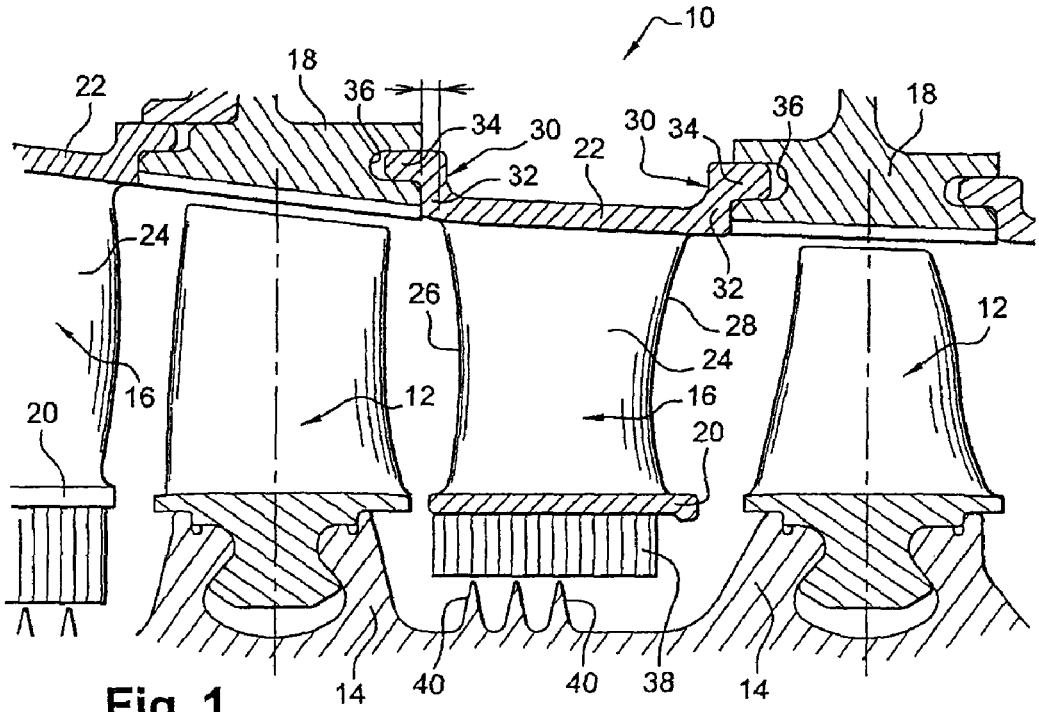
Fig. 1 PRIOR ART
FIG. 1 is a partial schematic view in axial section of a turbomachine high pressure compressor, and represents a fixed stator assembly formed by casting according to the prior art.

The compressor 10 in FIG. 1 comprises several compression stages of which only two are represented, each stage comprising an annular array of mobile blades 12, whose radially inner ends are fixed to a disk 14 supported by a rotor shaft, not shown, and an annular array of fixed stators 16, arranged downstream of the annular array of mobile blades 12 and supported by an outer cylindrical casing 18.

The annular arrays of fixed stators 16 are sectorized and formed of stator assemblies that are mounted circumferentially end-to-end about the axis of the compressor. Each of these stator assemblies comprises two coaxial rings, an inner ring 20 and an outer ring 22, for example in a portion of a cylinder, that extend one inside the other and that are connected to one another by radial airfoils 24. These airfoils 24 have an inner concave surface or intrados and an outer convex surface or extrados that are connected at their upstream and downstream ends forming leading edges 26 and trailing edges 28 for the air that flows in the compressor.

Each fixed stator assembly is coupled to the outer casing 18 by means of two outer annular lugs 30 formed at the axial ends of the outer ring 22, each annular lug 30 comprising an annular portion 32 that extends substantially radially outward from the end of the ring 22, and a portion 34, substantially in a portion of a cylinder, that extends upstream or downstream respectively, from the radially outer end of the annular portion 32 and that is engaged in a corresponding annular groove 36 of the casing.

The inner surface of the outer ring 22 is aligned with the inner surface of revolution of the casing 18. A block of material 38 is attached to the inner surface of the inner ring 20 and designed to interact sealingly with the annular ribs 40 of the compressor rotor shaft, to prevent gases traveling between the inner ring 20 and the rotor shaft.

The stator assembly of FIG. 1 is formed in a single piece, particularly by casting, which makes it possible to minimize the axial dimension of the outer ring 22 and hence the axial space requirement of the stator assembly by bringing the outer lugs 30 closer to the leading edges 26 and trailing edges 28 of the radial airfoils. The leading edges 26 and trailing edges 28 of the airfoils are thus connected to thick and rigid portions of the ring that are not sufficiently flexible to partly absorb the stresses to which the leading and trailing edges of the airfoils are subjected in operation.

Figure 2:
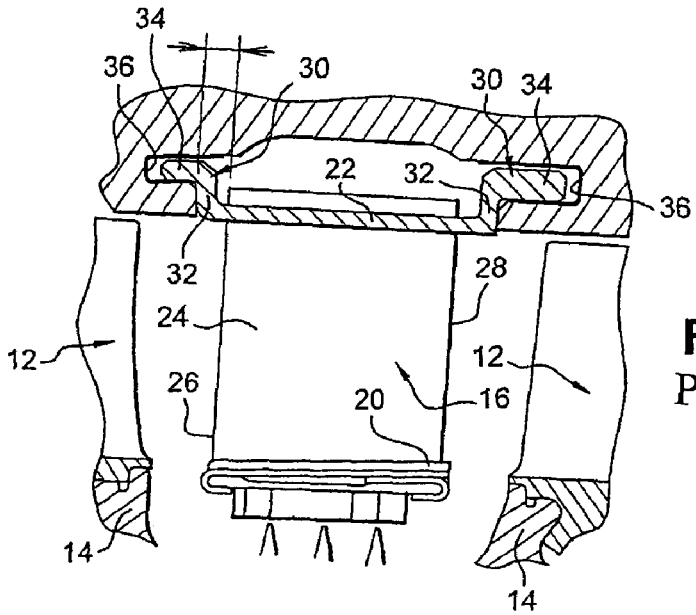
Fig. 2 PRIOR ART
FIG. 2 represents another fixed stator assembly of the prior art.

The stator assembly of FIG. 2 is formed by assembling radial airfoils 24 to rings 20, 22, more precisely by fitting and welding or brazing the ends of the airfoils 24 into corresponding orifices of the rings 20, 22. The axial space requirement of such an assembly is greater than that of the assembly of FIG. 1 because the coupling lugs 30 of the assembly are necessarily separated, upstream and downstream respectively, from the mounting orifices of the radial airfoils. However, this embodiment allows the leading and trailing edges of the airfoils to be connected to relatively thin ring portions that are sufficiently flexible to absorb a portion of the stresses to which the leading edges 26 and trailing edges 28 of the airfoils are subjected in operation.

The present invention makes it possible to combine the advantages and avoid the disadvantages of these two embodiments.

Figure 3:
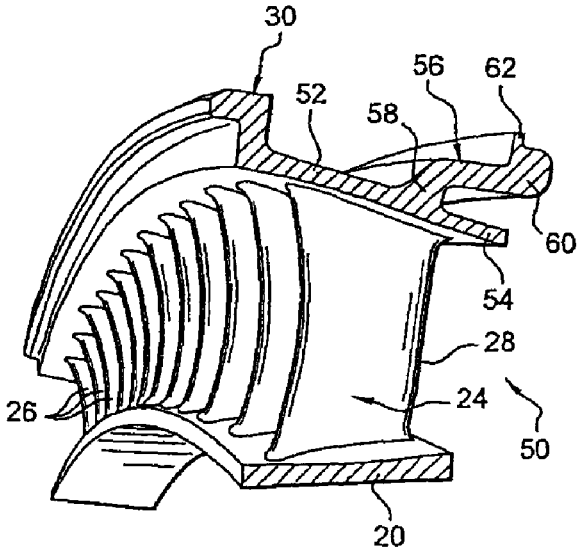
FIG. 3 is a schematic view in perspective of a fixed stator assembly according to the invention.

In a first embodiment of the invention represented in FIG. 3, the outer ring 52 of the stator assembly 50 comprises a downstream rim 54 substantially in a portion of a cylinder that is axially aligned with the rest of the ring and that extends substantially parallel to the downstream annular lug 56 and to the inside of the latter. This lug 56 comprises an annular portion 58 that extends substantially radially outward from the ring 52, and a portion 60 substantially in a portion of a cylinder or a cone that extends downstream from the radially outer end of the annular portion 58 and that is designed to be engaged in an annular groove of the casing 18.

The radial portion 58 of the downstream lug 56 is connected to the outer ring 52 upstream of the trailing edges 28 of the radial airfoils 24, that are connected to the rim 54 forming the downstream end of the outer ring 52. Since this rim 54 is not used for connecting the outer lug 56 and does not participate in the coupling of the stator assembly to the casing, its thickness may be reduced to give it a certain flexibility, which allows it to partly absorb the stresses applied to the trailing edges of the airfoils 24 in operation. The thickness of the rim 54 may be substantially equal to or less than that of the rest of the ring (excluding the zones for connecting the outer coupling lugs).

The portion 60 of the downstream lug 56 also comprises a radially outer annular rib 62 designed to abut a corresponding surface of the casing when the portion 60 of the lug is engaged in the groove of the casing. In FIG. 1, this surface is radial and formed by a cylindrical rim of the casing 18.

The inner ring 20, the airfoils 24 and the upstream annular lug 30 are similar to those of the assembly of FIG. 1.

Figure 4:
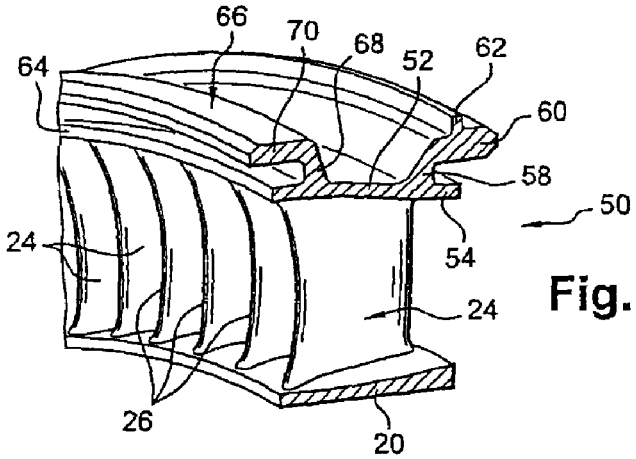
FIGS. 4 and 5 are schematic views in perspective of variant embodiments of the fixed stator assembly according to the invention.

The assembly 50 represented in FIG. 4 differs from that of FIG. 3 in that the outer ring 52 also comprises an upstream rim 64 substantially in a portion of a cylinder that is axially aligned with the rest of the ring and that extends substantially parallel to the upstream annular coupling lug 66 of the assembly and inside the latter. This lug 66 comprises an annular portion 68 that extends substantially radially outward from a portion of the ring situated downstream of the zone for connecting the leading edges 26 of the airfoils, and a second portion 70 substantially in a portion of a cylinder that extends substantially axially upstream from the radially outer end of the annular portion 68 and that is designed to be engaged in an annular groove of the casing 18.

In this embodiment, the upstream annular lugs 66 and downstream annular lugs 56 are separated from one another by a mid-portion of outer ring 52 that has substantially the same radial dimension or thickness as the upstream rim 64 and downstream rim 54 of this ring. This makes it possible to optimize the frequencies specific to the airfoils 24 and to the outer ring 52 while improving the transmission of stresses between the leading and trailing edges of the airfoils and the outer ring.

Figure 5:
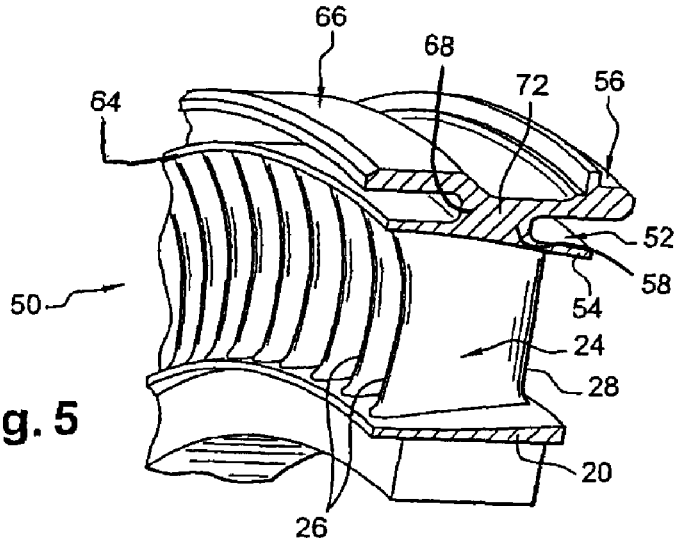

In the variant embodiment of FIG. 5, the upstream annular coupling lug 66 and downstream annular coupling lug 56 are connected to a mid-portion 72 of the outer ring that has a radial dimension or thickness that is markedly greater than those of the upstream rim 64 and downstream rim 54 of the outer ring. In the example shown, the first radial portions 58, 68 of the upstream lug 66 and downstream lug 56, respectively, are formed by the thick mid-portion of the outer ring 52. This embodiment also makes it possible to improve the transmission of stresses between the airfoils and the outer ring.

Naturally, the invention is not limited to the embodiments that have been described in the foregoing and shown in the appended drawings. For example, the stator assembly of FIG. 3 could be formed with a rim 54 at its upstream end and with an annular lug 30 at its downstream end, the reverse of what is shown.

The invention claimed is:

1. An assembly of sectorized fixed stators for a turbomachine compressor, made in a single piece and comprising:

an inner ring;

an outer ring;

radial airfoils extending between the inner and outer rings and such that an inner radial end is connected to the inner ring and an outer radial end is connected to the outer ring; and a first upstream outer annular lug and a second downstream outer annular lug supported by the outer ring for mounting the assembly of stators on a casing, wherein leading edges or trailing edges of the airfoils are connected to zones of the outer ring that are less rigid than those connected to the annular mounting lugs, wherein the outer ring includes a first upstream rim that extends substantially parallel to the first upstream outer annular lug to which the leading edges of the airfoils are connected and a second downstream rim that extends substantially parallel to the second downstream outer annular lug to which the trailing edges of the airfoils are connected, and wherein the second downstream outer annular lug axially extends beyond the second downstream rim in the downstream direction.

2. The assembly as claimed in claim 1, wherein the first upstream outer annular lug and the first upstream rim are connected to a mid-portion of the outer ring which has substantially the same radial dimension or thickness as the first upstream rim.

3. The assembly as claimed in claim 1, wherein the second downstream outer annular lug and the second downstream rim are connected to a mid-portion of the outer ring which has substantially the same radial dimension or thickness as the downstream rim.

4. The assembly as claimed in claim 1, wherein the first upstream outer annular lug and the first upstream rim are connected to a mid-portion of the outer ring which has a radial dimension or thickness greater than a radial dimension or thickness of the first upstream rim.

5. The assembly as claimed in claim 4, wherein the second downstream outer annular lug and the second outer downstream rim are connected to the mid-portion of the outer ring and the radial dimension or thickness of the mid-portion is greater than a radial dimension or thickness of the second downstream rim.

6. The assembly as claimed in claim 5, wherein a first end of the first upstream outer annular lug is free, a first end of the first upstream rim is free, and an upstream side of the mid-portion forms a first radial portion of the first upstream annular lug which connects a second end of the first upstream outer annular lug and a second end of the first upstream rim.

7. The assembly as claimed in claim 6, wherein a first end of the second outer downstream annular lug is free, a first end of the second downstream rim is free, and a downstream side of the mid-portion forms a first radial portion of the second outer downstream annular lug which connects a second end of the second outer downstream annular lug and a second end of the second downstream rim.

8. The assembly as claimed in claim 7, wherein a radially inner face of the first outer upstream annular lug, a radially outer face of the first upstream rim and an axial upstream face of the mid-portion define a first space.

9. The assembly as claimed in claim 8, wherein a radially inner face of the second outer downstream annular lug, a radially outer face of the second downstream rim and an axial downstream face of the mid-portion define a second space.

10. The assembly as claimed in claim 1, wherein the second downstream outer annular lug and the second downstream rim are connected to a mid-portion of the outer ring which has a radial dimension or thickness greater than a radial dimension or thickness of the second downstream rim.

11. The assembly as claimed in claim 1, wherein one of the outer annular lugs is connected to an axial end of the outer ring.

12. The assembly as claimed in claim 1, wherein one of the outer annular mounting lugs comprises at least one radially outer annular rib which abuts a corresponding surface of the casing.

13. The assembly as claimed in claim 1, which is made by casting.

14. A turbomachine compressor comprising at least one annular array of fixed stators made up of assemblies of stators as claimed in claim 1, mounted circumferentially end to end about the axis of the compressor.

15. A turbomachine comprising a compressor as claimed in claim 14.

* * * * *